United States Patent [19]

Yashiki

[11] Patent Number: 4,571,371

[45] Date of Patent: Feb. 18, 1986

[54] ELECTROPHOTOGRAPHIC PHOTOSENSITIVE LAYER COMPRISING SILICONE COMPOUND LEVELING AGENT

[75] Inventor: Yuichi Yashiki, Yokohama, Japan

[73] Assignee: Canon Kabushiki Kaisha, Tokyo, Japan

[21] Appl. No.: 607,564

[22] Filed: May 7, 1984

[30] Foreign Application Priority Data

May 11, 1983 [JP] Japan ..... 58-82252

[51] Int. Cl.[4] ..... G03G 15/04

[52] U.S. Cl. ..... 430/62; 430/60; 430/63; 430/64; 430/65

[58] Field of Search ..... 430/60, 62, 63, 65, 430/64

[56] References Cited

U.S. PATENT DOCUMENTS

| | | | |
|---|---|---|---|
| 3,394,001 | 7/1968 | Makino | 430/64 |
| 4,046,562 | 9/1977 | Glowinski et al. | 430/64 X |
| 4,251,612 | 2/1981 | Chu et al. | 430/63 X |
| 4,281,055 | 7/1981 | Moriguchi et al. | 430/60 |
| 4,362,799 | 12/1982 | Kondo et al. | 430/67 |
| 4,371,600 | 2/1983 | Schank et al. | 430/66 X |
| 4,405,702 | 9/1983 | Shirai et al. | 430/60 |

FOREIGN PATENT DOCUMENTS

| | | | |
|---|---|---|---|
| 2971151 | 11/1979 | Fed. Rep. of Germany | 430/67 |
| 0003534 | 1/1979 | Japan | 430/66 |
| 0108668 | 8/1980 | Japan | 430/66 |

OTHER PUBLICATIONS

Research Disclosure, May 1973, 10939–Leveling Agent for Electrophotographic Films.

*Primary Examiner*—John E. Kittle
*Assistant Examiner*—Mukund J. Shah
*Attorney, Agent, or Firm*—Fitzpatrick, Cella, Harper & Scinto

[57] ABSTRACT

An electrophotographic photosensitive member comprises a substrate and a photosensitive layer, and an electroconductive layer containing an electroconductive material, a binder and a leveling agent is provided between the substrate and the photosensitive layer. The silicone compound leveling agent improves the interfaces between the electroconductive layer and both the substrate and photosensitive layer.

18 Claims, No Drawings

ELECTROPHOTOGRAPHIC PHOTOSENSITIVE LAYER COMPRISING SILICONE COMPOUND LEVELING AGENT

BACKGROUND OF THE INVENTION

1. Field of the Invention

This invention relates to an electrophotographic photosensitive member, and more particularly, to an electrophotographic photosensitive member having an improved electroconductive layer.

2. Description of the Prior Art

An electrophotographic photosensitive member is fundamentally composed of a substrate and a photosensitive member. However, where the substrate is an insulating material such as paper, plastics and the like, an electroconductive film should be provided on the substrate so as to flow electric charges.

Where the substrate is made of a metal such as aluminum, copper, brass, stainless steel and the like, an electroconductive film is not necessary, but it is advantageous to form a coating layer on the substrate since this coating layer can improve the coating characteristics of the photosensitive layer, protect the photosensitive layer against electric breakdown, and cover defects on the surface of the substrate. Since the coating layer should have an electrostatically sufficiently low resistance, the coating layer should be an electroconductive film.

The electroconductive film as mentioned above is usually called an electroconductive layer. This electroconductive layer is conventionally composed of an electrolyte such as lithium chloride, sodium chloride and the like dissolved in a water-soluble resin such as polyvinyl alcohol, methylcellulose and the like, or a high polymer electrolyte such as high polymer quaternary ammonium salt, high polymer sulfonates, and the like. However, resistance of such electroconductive layer increases under low humidity conditions so that it is not suitable for electrophotographic photosensitive members. In addition, when an electroconductive layer is formed for the purpose of covering defects on the surface of a substrate, it is necessary to have a thick electroconductive layer and therefore, it is necessary to lower the resistance of the electroconductive layer.

An electroconductive layer is difficult to be produced by using only a single resin. In general, electroconductive powders are dispersed in a resin to produce an electroconductive layer.

As the electroconductive powders, there are used metal powders such as nickel, copper, silver, aluminum and the like, metal oxide powders such as iron oxide, tin oxide, antimony oxide, indium oxide and the like, carbon powders and the like. When these electroconductive powders are dispersed in resins, the resulting electroconductive coating material is composed of a dispersion of powders, and therefore, the surface of the resulting electroconductive layer is inevitably irregular or rough.

The surface property of the electroconductive layer largely contributes to the image quality obtained by the electrophotographic photosensitive member so that the surface of the electroconductive layer is required to be very clear and smooth.

However, as mentioned above, conventional electroconductive layers have defective surface property and therefore, electrophotographic photosensitive member using such electroconductive layer can not give good image quality.

SUMMARY OF THE INVENTION

It is an object of the present invention to provide an electrophotographic photosensitive member having a smooth surface of an electroconductive layer.

It is another object of the present invention to provide an electrophotographic photosensitive member capable of producing a copy of good image quality.

It is a further object of the present invention to provide an electrophotographic photosensitive member capable of being produced at a low cost.

According to the present invention, there is provided an electrophotographic photosensitive member which comprises an electroconductive layer containing an electroconductive material, a binder resin and a leveling agent between a substrate and a photosensitive layer.

DESCRIPTION OF THE PREFERRED EMBODIMENTS

As the leveling agent used in the present invention, a silicone leveling agent is one of the preferred leveling agents.

A film produced by using a dispersion coating material has drawbacks of coating properties, such as mottled color, flooding, orange peel and the like which are caused by the pigments (electroconductive powders) in the coating material. In addition, agglomeration of the pigments causes shrivelling.

The present inventor has found that these drawbacks can be removed by adding a silicone leveling agent.

Although it is not desired to limit the invention to any particular theory, it is believed that the addition of the silicone leveling agent to the electroconductive coating material results in decrease in surface tension of the coating material and thereby defects of coating are difficult to occur.

The silicone leveling agents which may be used in the present invention have the following structural formula:

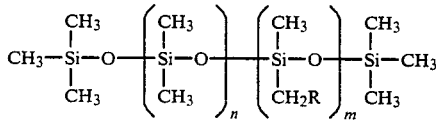

Representative silicone leveling agents are dimethyl polysiloxane (R = H in the above formula) and modified silicone leveling agents in which R in the above formula is alkyl such as methyl, ethyl, propyl and the like, alkylaryl such as methylaryl, ethylaryl, and the like, glycol residue, hydroxy, hydroxyalkyl such as hydroxymethyl, hydroxyethyl, and the like, amino and the like, for example, alkyl modified silicone, alkylaryl modified silicone, polyether modified silicone, glycol modified silicone, alcohol modified silicone, amine modified silicone and the like. n and m are positive integers.

As the silicone leveling agents, those having a molecular weight of 200–100,000 are preferable, and those having a molecular weight of 1,000–10,000 are more preferable. The amount of the silicone leveling agent to be added is preferably 0.001–1% by weight based on the non-volatile matter of the electroconductive coating material, that is, the resulting electroconductive layer. Where the amount is less than 0.001% by weight, the desired effect can not be obtained. On the contrary, where the amount is more than 1% by weight, there is a fear that it is difficult to apply a photosensitive layer or an adhesive layer onto the electroconductive layer.

As the electroconductive material contained in the electroconductive layer, electroconductive powders are preferably mentioned.

As the electroconductive powders, there may be mentioned metal powders such as nickel, silver, aluminum and the like, metal oxide powders such as iron oxide, tin oxide, antimony oxide, indium oxide and the like, and carbon powders.

The particle size of the electroconductive powders is preferably 0.01–1$\mu$. The amount of the electroconductive powders in the electroconductive layer is preferably 10–90% by weight, more preferably 40–8% by weight.

The resins in which the electroconductive powders are dispersed may be those capable of satisfying the following conditions:

(a) The resin can strongly adhere to the substrate;

(b) The electroconductive powders can be dispersed in the resin very well; and (c) The resin is sufficiently resistance to solvents.

Preferable resins are thermosetting resins such as curable rubber, polyurethan resins, epoxy resins, alkyd resins, polyester resins, silicone resins, acrylmelamine resins and the like.

Volume resistivity of the electroconductive layer is preferably $10^{13}$ ohm.cm or less, more preferably $10^{12}$ ohm.cm or less. The composition of the layer components may be selected to give the desired volume resistivity. When the volume resistivity of the resin is sufficiently low, it is possible to add a nonconductive pigment to the electroconductive layer. As the non-conductive pigment, there may be mentioned zinc oxide, titanium oxide, calcium carbonate, alumina, barium carbonate, barium sulfate and the like. These pigments are useful for increasing whiteness and reducing the cost of the coating material. The pigments may be dispersed by a conventional means such as roll-mill, ball-mill, vibrating ball-mill, attriter, sand-mill, colloid-mill and the like. When the substrate is in sheet form, coating may be effected by wire-bar coating, blade coating, knife coating, roll coating, screen coating, and the like. When the substrate is in cylinder form, a soak coating is suitable.

Thickness of the electroconductive layer is varied depending upon the surface roughness of the substrate, and such thickness capable of giving smoothness of the resulting surface of the electroconductive layer is selected. The thickness is preferable at least twice the maximum roughness of the substrate surface.

When a photosensitive layer is directly coated on the electroconductive layer, there occur sometimes the followings, that is, the photosensitive material penetrates into fine holes in the electroconductive layer, is buried in the fine holes, or the interaction of the electroconductive powders and the photosensitive material changes the photosensitive characteristics. Therefore, it is preferable to form a resin layer (adhesive layer) not containing electroconductive powders on the electroconductive layer. As the resin for the resin layer, there may be mentioned, for example, water-soluble resins such as polyvinyl alcohol, polyvinyl methyl ether, polyvinylpyridine, polyvinylpyrrolidone, polyethylene oxide, polyacrylic acids, methylcellulose, ethylcellulose, polyglutamic acid, casein, gelatin, starch and the like, and polyamide resins, phenolic resins, polyvinylformal, polyurethan elastomers, alkyd resins, ethylene-vinyl acetate copolymer, vinylpyrrolidone-vinyl acetate copolymer and the like resins. Polyamide resins are the most preferable. Polyamide resins are linear polyamide, and may be represented by so-called "nylon" and "copolymer nylon". According to the present invention, it is desirable to apply the polyamide in solution form to a substrate, and therefore, low-or non-crystal polyamide is preferable. Such polyamide may be obtained by copolymerizing two or more of materials for nylon to give a copolymerized polyamide resin. Further, so-called "Type 8 Nylon" produced by treating the amido groups of nylon with formaldehyde and alcohol is also effective. Thickness of the polyamide resin layer is usually about 0.3–2$\mu$.

On the adhesive layer or the electroconductive layer there is formed a photosensitive layer. The photosensitive layer is produced by coating photoconductive powders such as dye sensitized zinc oxide powders, selenium powders, amorphous silicone powders, phthalocyanine pigment powders and the like, or organic photoconductive material such as polyvinylcarbazole, oxadiazole and the like, if desired, together with a binder resin.

When organic photoconductive materials are used, in order to improve the characteristics, there may be combined a charge generation layer capable of generating charge carriers upon exposure and a charge transfer layer capable of transferring the generated charge carriers.

The charge generation layer may be formed by dispersing a charge generation material in a binder resin. As the charge generation material, there may be mentioned azo pigments such as Sudan Red, Diane Blue and the like, quinone pigments such as Algol Yellow, pyrenequinone and the like, quinocyanine pigments, perylene pigments, indigo pigments such as indigo, thioindigo and the like, bis-benzimidazole pigments such as Indo Fast Orange toner and the like, phthalocyanine pigments such as copper phthalocyanine and the like, quinacridone pigments, pyrylium dyes, and the like. As the binder resin, there are, for example, polyester, polystyrene, polyvinyl acetate, acrylic resins, polyvinyl butyral, polyvinylpyrrolidone, methylcellulose, hydroxypropylmethyl cellulose, cellulose esters and the like. In addition, the charge generation layer may be produced by vapor deposition. Thickness of the charge generation layer is about 0.05–0.2$\mu$.

The charge transfer layer may be formed by dissolving a hole transferring material in a filmshapeable resin since charge transfer materials are generally of low molecular weight and have only a poor film-shapeability.

Representative hole transfer materials are, for example, polycyclic aromatic compounds such as anthracene, pyrene, coronene, and the like, nitrogen containing cyclic compounds such as indoles, carbazoles, oxazoles, iso-oxazoles, thiazoles, imidazoles, pyrazoles, oxadiazoles, pyrazolines, thiadiazoles, triazoles and the like, hydrazone compounds, and the like.

As the above-mentioned film-shapeable resin, there may be mentioned polycarbonate, polyarylate, polystyrene, polymethacrylic acid esters, styrenemethyl methacrylate copolymer, polyesters, styreneacrylonitrile copolymer, polysulfone and the like.

Thickness of the charge transfer layer is about 5–20$\mu$.

As the substrate, there may be used a material which itself has good electroconductivity such as aluminum, aluminum alloys, copper and the like, plastics having a metal film formed by vacuum vapor deposition, or a plastic or paper substrate which electroconductive powders are dispersed in or which is impregnated with electroconductive materials.

The shape of the substrate may be sheet, plate or drum, and the drum substrate may be produced by extrusion shaping.

The electrophotographic photosensitive member according to the present invention has a very smooth electroconductive layer so that it is not necessary that the substrate itself is electroconductive. Or the surface of the substrate may be so rough that the cost for processing the substrate can be reduced to a great extent.

The following examples are given for illustration of the present invention.

EXAMPLE 1

Eight parts (weight parts; in the following, "parts" are by weight unless otherwise specified) of titanium oxide powders (supplied by Sakai Kagaku K.K.), 8 parts of tin oxide powders (supplied by Mitsubishi Kinzoku K.K.), 16 parts of a one-liquid type epoxy resin (tradename, "U 33", produced by Amicon Japan) (concentration of the solid component being 50%) and 30 parts of toluene were dispersed in a ball-mill for 6 hours.

As a substrate, there was used an aluminum pipe of 60 mm in outer diameter and 260 mm in length. This pipe was manufactured by extruding shaping and had partly minor defects and protrusions on the surface. The dispersion as prepared above was applied to the surface of the pipe by soaking and heated at 170° C. to cure resulting in an electroconductive layer of 20μ thick.

When the resulting surface was observed, there was crawling of the electroconductive layer at the portions corresponding to the protrusions present on the substrate and there was also small sagging like orange peel over the whole surface.

On the contrary, when a coating material prepared by adding 0.024 parts of an acrylic modified silicone (tradename, "DC 3PA", produced by Toray Silicone K.K.) was applied to the same substrate, and there was obtained a very smooth electroconductive layer free from crawling and sagging.

A copolymer type polyamide resin (tradename, "CM 8000", produced by Toray K.K.) 1 part and Type 8 nylon resin (tradename, "EF 30T", produced by Teikoku Kagaku K.K.) 1 part were dissolved in methanol 10 parts and toluene 8 parts. The resulting solution was applied to the surface of the electroconductive layer as obtained above to produce a polyamide resin layer (an adhesive layer) of 0.5μ thick.

Fifty parts of zinc oxide powders for electrophotography (produced by Hakusui Kagaku) was added to a solution composed of 0.2 part of Rose Bengal (tradename, "N 164", produced by Dainihon Ink K.K.). 5 parts of methanol and 50 parts of n-heptane followed by dispersing for 20 minutes by means of a homogenizer. The resulting dispersion was filtered by sucking to recover the product, which was dried at 80° C. to produce a dye-sensitized zinc oxide.

To 30 parts of the dye-sensitized zinc oxide thus produced were added 12 parts of an acrylic resin (tradename, "Acrybase CMZ-20", produced by Fujikura Kasei, 40% solid matter) and 45 parts of toluene and dispersed for 4 hours by a ball-mill. The resulting dispersion was applied to the above-mentioned underlying layer to form a photosensitive layer of 22μ thick and dried at 80° C.

Then, to the surface of the photosensitive layer was applied an emulsion of an acrylic resin having a weight average molecular weight of about 120,000 and a glass transition temperature of about 90° C. (tradename, "Aron HD-11", produced by Toa Gosei Kagaku K.K.) diluted with water, and dried at 70° C. by hot air to produce a protective layer of 4μ thick.

The resulting photosensitive member was used for a copying machine where there are conducted charging at −5.5 KV, imagewise exposure, development with dry toner, transferring to plain papers and blade cleaning by pressing a urethan rubber blade of 1 mm thick having hardness of 70° against the surface of the photosensitive member at an angle of 30° at 4 gm/cm.

The photosensitive member having an electroconductive layer containing silicone gave a good image quality when used for copying. On the contrary, the photosensitive member having an electroconductive layer containing no silicone gave images remarkably suffering from white dots and mottles.

EXAMPLE 2

By using a ball-mill for 6 hours, there were dispersed titanium oxide powders (produced by Chitan Kogyo K.K.) 10 parts, tin oxide powders (produced by Mitsubishi Kinzoku K.K.) 7 parts, acrylic resin (tradename, "Acrydic A 405", produced by Dainihon Ink K.K.) 16 parts, melamine resin (tradename, Super Beckamine L 121, produced by Dainihon Ink K.K.) 4 parts and toluene 20 parts. To the resulting dispersion was added 0.03 part of polyether modified silicone (tradename, "KP 301", produced by Shinetsu Kagaku K.K.).

The resunting coating material was applied to a cylinder in a way similar to that in Example 1 and cured at 150° C. for 30 min. to form an electroconductive layer of 20μ thick.

On the resulting electroconductive layer was formed the same polyamide resin layer as that in Example 1.

Ten parts of a disazo pigment of the following formula,

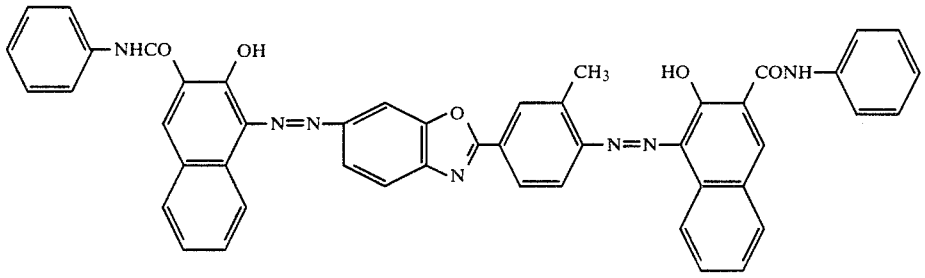

6 parts of cellulose acetate butyrate resin (tradename, "CAB-381", produced by Eastman Chemical Co.) and 60 parts of cyclohexanone were dispersed for 20 hours by means of a sandmill device using 1 mm size glass beads. To the dispersion thus produced was added 100 parts of methyl ethyl ketone, and the resulting mixture was applied to the surface of the above-mentioned underlying layer by soaking and dried by heating at 100° C. for 10 min. to form a charge generation layer of 0.1 g/m$^2$.

Ten parts of a hydrazone compound of the formula,

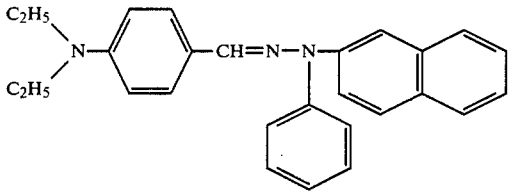

and 12 parts of styrene-methylmethacrylate copolymer resin (tradename, "MS-200", produced by Seitetsu Kagaku K.K.) were dissolved in 70 parts of toluene, and the resulting solution was applied to the charge generation layer followed by drying at 100° C. for 60 min. to form a charge transfer layer of 16$\mu$ thick.

The electrophotographic photosensitive member thus produced was used for a copying machine, and the copying machine gave images of good quality.

EXAMPLES 3-5

Following the procedure described in Example 1 but substituting a glycol modified silicone (tradename, "SH28PA", produced by Toray Silicone K.K.) - Example 3, substituting an alcohol modified silicone (tradename, "SF 8427", produced by Toray Silicone K.K.) - Example 4, and substituting an alkylaryl modified silicone (tradename, "SH 230", produced by Toray Silicone K.K.) - Example 5, respectively, for the acrylic modified silicone, were produced electrophotographic photosensitive members. The resulting electrophotographic photosensitive members were used for a copying machine such as that in Example 1, and copied images of high quality were obtained.

What is claimed is:

1. An electrophotographic photosensitive member which comprises an electroconductive layer having a volume resistivity of not more than $10^{13}$ ohm·cm and containing a mixture of an electroconducitve power, a binder resin and a silicone compound leveling agent, said agent in an amount of 0.001 to 1% by weight of the electroconductive layer, between a substrate made of a metal or alloy and a photosensitive layer.

2. An electrophotographic photosensitive member according to claim 1 in which the leveling agent is a silicone compound of the formula (1):

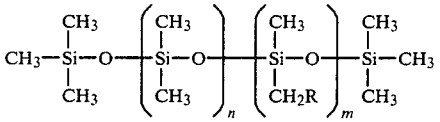

(1)

where R is a member selected from the group consisting of hydrogen, alkyl, alkylaryl, glycol residue, hydroxyalkyl, hydroxy, and amino, and n and m are positive integers.

3. An electrophotographic photosensitive member according to claim 2 in which the leveling agent is a member selected from the group consisting of dimethylpolysiloxane, alkyl modified silicone, alkylaryl modified silicone, polyether modified silicone, glycol modified silicone, alcohol modified silicone, and amine modified silicone.

4. An electrophotographic photosensitive member according to claim 1 in which the electroconductive material is electroconductive powders of a member selected from the group consisting of nickel, copper, silver, aluminum, iron oxide, tin oxide, antimony oxide, indium oxide and carbon.

5. An electrophotographic photosensitive member according to claim 1 in which the electroconductive layer contains a non-electroconductive pigment.

6. An electrophotographic photosensitive member according to claim 5 in which the non-electroconductive pigment is a member selected from the group consisting of zinc oxide, titanium oxide, calcium carbonate, aluminum oxide, barium carbonate and barium sulfate.

7. An electrophotographic photosensitive member according to claim 1 in which an adhesive layer is provided between the electroconductive layer and the photosensitive layer.

8. An electrophotographic photosensitive member according to claim 7 in which the adhesive layer is a film containing a member selected from the group consisting of polyvinyl alcohol, polyvinyl methyl ether, polyvinyl pyridine, polyvinyl pyrrolidone, polyethylene oxide, polyacrylic acid, methylcellulose, ethylcellulose, polyglutamic acid, casein, gelatin, starch, polyamide resins, phenolic resins, polyvinylformal, polyurethan elastomer, alkyd resins, ethylene-vinyl acetate copolymer and vinylpyrrolidone-vinyl acetate copolymer.

9. An electrophotographic photosensitive member according to claim 7 in which the adhesive layer is a film composed of polyamide resins.

10. An electrophotographic photosensitive member according to claim 9 in which the polyamide resins are copolymerized polyamide resins.

11. An electrophotographic photosensitive member according to claim 1 in which the photosensitive layer is a film containing a photoconductive powder and a binder.

12. An electrophotographic photosensitive member according to claim 1 in which the photosensitive layer has a laminate structure composed of a charge generation layer and a charge transfer layer.

13. An electrophotographic photosensitive member according to claim 12 which the charge generation layer is a film containing a pigment or dye selected from the group consisting of azo pigments, quinone pigments, quinocyanine pigments, perylene pigments, indigo pigments, phthalocyanine pigments, quinacridone pigments and pyrylium dyes.

14. An electrophotographic photosensitive member according to claim 12 in which the charge generation layer is a film containing azo pigments and a binder.

15. An electrophotographic photosensitive member according to claim 14 in which the azo pigments are disazo pigments.

16. An electrophotographic photosensitive according to claim 12 in which the charge generation layer contains phthalocyanine pigments and a binder.

17. An electrophotographic photosensitive member according to claim 12 in which the charge transfer layer is a film containing a charge transfer material selected from the group consisting of polycyclic aromatic compounds, nitrogen containing heterocyclic compounds, and hydrazone compounds, and a binder.

18. An electrophotographic photosensitive member according to claim 12 in which the charge transfer layer is a film containing a hydrazone compound and a binder.

* * * * *

UNITED STATES PATENT AND TRADEMARK OFFICE

CERTIFICATE OF CORRECTION

PATENT NO. : 4,571,371

DATED : FEBRUARY 18, 1986

INVENTOR(S) : YUICHI YASHIKI

It is certified that error appears in the above-identified patent and that said Letters Patent is hereby corrected as shown below:

COLUMN 3

Line 16, "40-8% by" should read --40-80% by--.

COLUMN 4

Line 9, "low-or" should read --low- or--.
Line 52, "filmshapeable" should read --film-shapeable--.

COLUMN 7

Line 64, " an electroconducitve power," should read --an electroconductive powder,--.

COLUMN 9

Line 14, "12 which" should read --12 in which--.

UNITED STATES PATENT AND TRADEMARK OFFICE

CERTIFICATE OF CORRECTION

PATENT NO. : 4,571,371

DATED : FEBRUARY 18, 1986

INVENTOR(S) : YUICHI YASHIKI

It is certified that error appears in the above-identified patent and that said Letters Patent is hereby corrected as shown below:

COLUMN 10

Line 7, "photosensitive according" should read --photosensitive member according--.

Signed and Sealed this

Seventh Day of April, 1987

*Attest:*

*Attesting Officer*

DONALD J. QUIGG

*Commissioner of Patents and Trademarks*